US009540979B2

(12) United States Patent
Hasegawa et al.

(10) Patent No.: US 9,540,979 B2
(45) Date of Patent: Jan. 10, 2017

(54) WORKING VEHICLE

(71) Applicant: Kubota Corporation, Osaka (JP)

(72) Inventors: Koichi Hasegawa, Sakai (JP); Masatoshi Iwamoto, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 14/488,711

(22) Filed: Sep. 17, 2014

(65) Prior Publication Data

US 2015/0135686 A1 May 21, 2015

(30) Foreign Application Priority Data

Nov. 18, 2013 (JP) ..... 2013-237745

(51) Int. Cl.

| | |
|---|---|
| ***F01N 3/00*** | (2006.01) |
| ***F01N 3/035*** | (2006.01) |
| ***F01N 13/18*** | (2010.01) |
| ***F01N 13/00*** | (2010.01) |
| ***F01N 3/023*** | (2006.01) |
| ***F01N 13/08*** | (2010.01) |

(52) U.S. Cl.

CPC ..... *F01N 3/035* (2013.01); *F01N 3/0231* (2013.01); *F01N 13/002* (2013.01); *F01N 13/009* (2014.06); *F01N 13/08* (2013.01); *F01N 13/1805* (2013.01); *F01N 2590/08* (2013.01)

(58) Field of Classification Search

CPC ..... F01N 3/035; F01N 3/0231; F01N 3/025; F01N 3/10; F01N 3/0807; F01N 3/2066; F01N 13/002; F01N 13/08; F01N 13/009; F01N 13/1805; F01N 13/1822; F01N 2590/08; F02M 35/04; F02M 35/1015; F02M 35/10268

USPC ..... 60/297, 282, 311

See application file for complete search history.

(56) References Cited

U.S. PATENT DOCUMENTS

| | | | | |
|---|---|---|---|---|
| 2004/0088968 | A1* | 5/2004 | Koelm | B08B 15/02 60/282 |
| 2010/0186381 | A1* | 7/2010 | Charles | F01N 3/025 60/282 |
| 2010/0187383 | A1* | 7/2010 | Olsen | F01N 13/1805 248/201 |

FOREIGN PATENT DOCUMENTS

| | | | |
|---|---|---|---|
| JP | 2009-167806 | A | 7/2009 |
| JP | 2012215022 | A | 11/2012 |

* cited by examiner

*Primary Examiner* — Audrey K Bradley
*Assistant Examiner* — Kelsey Stanek
(74) *Attorney, Agent, or Firm* — The Webb Law Firm

(57) ABSTRACT

A work vehicle includes a Diesel Particulate Filter DPF and a Selective Catalytic Reuction SCR connected to one another and disposed upwardly of an engine mounted in an engine room covered by a hood located forwardly of a driving operation section, the DPF and the SCR being disposed in juxtaposition in a vehicle body transverse direction.

13 Claims, 12 Drawing Sheets

WORKING VEHICLE

CROSS-REFERENCE TO RELATED APPLICATION

This application claims priority to Japanese Patent Application No. 2013-237745 filed Nov. 18, 2013, the disclosure of which is hereby incorporated in its entirety by reference.

BACKGROUND OF THE INVENTION

Field of the Invention

The present invention relates to a working vehicle having a DPF and an SCR as an exhaust gas cleaning device.

Description of the Related Art

A Diesel Particulate Filter (to be referred to shortly as "DPF" in this disclosure) and a Selective Catalytic Reduction (to be referred to shortly as "SCR" in this disclosure) for cleaning exhaust gas from an engine are known from e.g. Japanese Unexamined Patent Application Publication No. 2009-167806 (Patent Document 1). In this document, there is described an exhaust gas cleaning device for an engine, consisting of a DPF and an SCR arranged in juxtaposition, a connecting pipe connecting one side end of the DPF and the other side end of the SCR, and a reducing agent supplying nozzle disposed upstream of the connecting pipe.

With the exhaust gas cleaning device configured as above, exhaust gas from an engine is fed to the DPF and PM (particulate matters) contained in the exhaust gas are collected by the DPF. The exhaust gas past the DPF is then fed to the SCR via the connecting pipe. In the course of this, an amount of reducing agent (e.g. ammonia) is injected into the connecting pipe from the reducing agent supplying nozzle to be mixed with the exhaust gas. With this, inside the SCR, there occurs a chemical reaction between the reducing agent and nitrogen oxides contained in the exhaust gas, whereby the nitrogen oxides are reduced to nitrogen, a harmless substance, and water. According to the technique described in Patent Document 1, mixing between the reducing agent and exhaust gas is promoted by securing a long total length for the connecting pipe.

However, when an exhaust gas cleaning gas consisting of a DPF and an SCR is applied to a working vehicle such as a tractor, following problems occur.

Normally, an engine of a working vehicle is housed in an engine room covered by a hood and having only a limited space. For this reason, it is contemplated to dispose the exhaust gas cleaning device outside the engine hood. Yet, if consideration is given to possibility of interference between such exhaust gas cleaning device disposed outside the hood and various working implements (e.g. a front loader, etc.) mounted on the working vehicle, a location allowing mounting of such working implement(s) will necessarily be limited and readiness in mounting the working implement too will be deteriorated. For allowing smooth mounting of the implement, a significant design change (e.g. change of the wheel base, etc.) will become necessary in the working vehicle per se.

Thus, it becomes necessary to enlarge the hood for allowing accommodation of the exhaust gas cleaning device within a resultantly enlarged engine room. However, this enlargement of the engine room, i.e. enlargement of the hood, results in blocking of operator's view by the hood, which in turn can lead to deterioration in the operator's visibility and operability of the working vehicle.

SUMMARY OF THE INVENTION

The object of the present invention is to provide a working vehicle capable of ensuring good view for the operator in spite of a DPF and an SCR being disposed within an engine room covered by a hood.

For accomplishing the above-noted object, a working vehicle having an exhaust gas cleaning device according to the present invention comprises: a driving operation section; an engine disposed in an engine room covered by a hood disposed forwardly of the driving operation section; a DPF mounted upwardly of the engine, and an SCR disposed upwardly of the engine in juxtaposition with the DPF in a vehicle body transverse direction. The DPF includes an upper face portion, a bottom face portion, a first lateral face portion and a second lateral face portion. The SCR includes an upper face portion, a bottom face portion, a first lateral face portion and a second lateral face portion opposed to the first lateral face portion of the DPF. The working vehicle further comprises a connecting pipe including a first connecting end connected to the first lateral face portion of the SCR, a second connecting end connected to the second lateral face portion of the DPF, and a main body portion extending from the first connecting end to the second connecting end. The main body portion extends at positions lower than the upper face portion of the DPF and the upper face portion of the SCR. With the above-described configuration of the DPF and the SCR as an exhaust gas cleaning device, some free space is created in the peripheries of the DPF and the SCR in the engine room, so that the height of the hood can be reduced in this area. With this, it becomes possible to secure a wide viewing field (in particular, front lower viewing field obliquely on the left and right sides) as viewed forwardly from the driving operation section.

According to one preferred embodiment of the present invention, the DPF and the SCR respectively include a front face portion as a front end in a vehicle body front/rear direction and a rear face portion as a rear end in the vehicle body front/rear direction; and the DPF and/or SCR are (is) disposed with an inclination such that the front face portion is disposed higher than the rear face portion. At least a portion of the main body portion of the connecting pipe passes under the rear face portion of the DPF and/or the SCR disposed with the inclination. With this arrangement, the DPF and the SCR are disposed with forwardly downward inclination as seen from the driving operation section where a driver is located. Thus, the hood too can be formed with forwardly downward inclination. Consequently, it becomes possible to secure a wide viewing field (in particular, front lower viewing field) as viewed forwardly from the driving operation section over the hood. Further, as the connecting pipe passes through the space under the rear face portions of the DPF and the SCR, the DPF and the SCR and a portion of the connecting pipe together form a double-layered structure, thus reducing the space occupied by these components in the front/rear direction.

According to one preferred embodiment of the present invention, the first connecting end of the connecting pipe is connected to vicinity of the front face portion of the SCR and the second connecting end of the connecting pipe is connected to vicinity of the front face portion of the DPF; and the main body portion of the connecting pipe extends in a U-shape form rearwards in the vehicle body front/rear direction, with a width thereof in the vehicle body traverse direction progressively increased to the forward side. With this configuration, it is possible to secure a long total width for the connecting pipe. Moreover, as the right/left width of the connecting pipe progressively increases to the forward side, the hood too can be formed to extend with a progressively increased width in the right/left direction to the forward side. With this, it becomes possible to secure a wide viewing field (in particular, front viewing field obliquely on the left and right sides) as viewed forwardly from the driving operation section.

According to one preferred embodiment of the present invention, a muffler for discharging exhaust gas to the outside is connected to the rear face portion or its periphery of the SCR, and the main body portion of the connecting pipe passes under the muffler. With this arrangement, space under the muffler can be effectively utilized for installment of the connecting pipe, thus improving space economy.

Next, there will be listed some preferred modes of layout of constituting members of the exhaust gas cleaning device which should contribute to further compactization of the exhaust gas cleaning device and effective utilization of the engine room made possible thereby.

(a) An inlet pipe connected to the engine is connected to a rear region of the bottom face portion of the DPF.

(b) The inlet pipe is bent to pass under the main body portion of the connecting pipe.

(c) The main body portion of the connecting pipe extends substantially on a horizontal plane.

(d) An inclined plane delimited by the bottom face portions of the DPF and the SCR has an inclination angle from 5 to 20 degrees relative to the horizontal plane delimited by the main body portion of the connecting pipe.

DETAILED DESCRIPTION OF THE PREFERRED EMBODIMENTS

In the following discussion, explanation will proceed, with reference to directions denoted by arrow U, arrow D, arrow F, arrow B, arrow L, arrow R being defined as representing the upward direction, the downward direction, the forward direction, the rearward direction, the left direction and the right direction, respectively.

Figure 1:
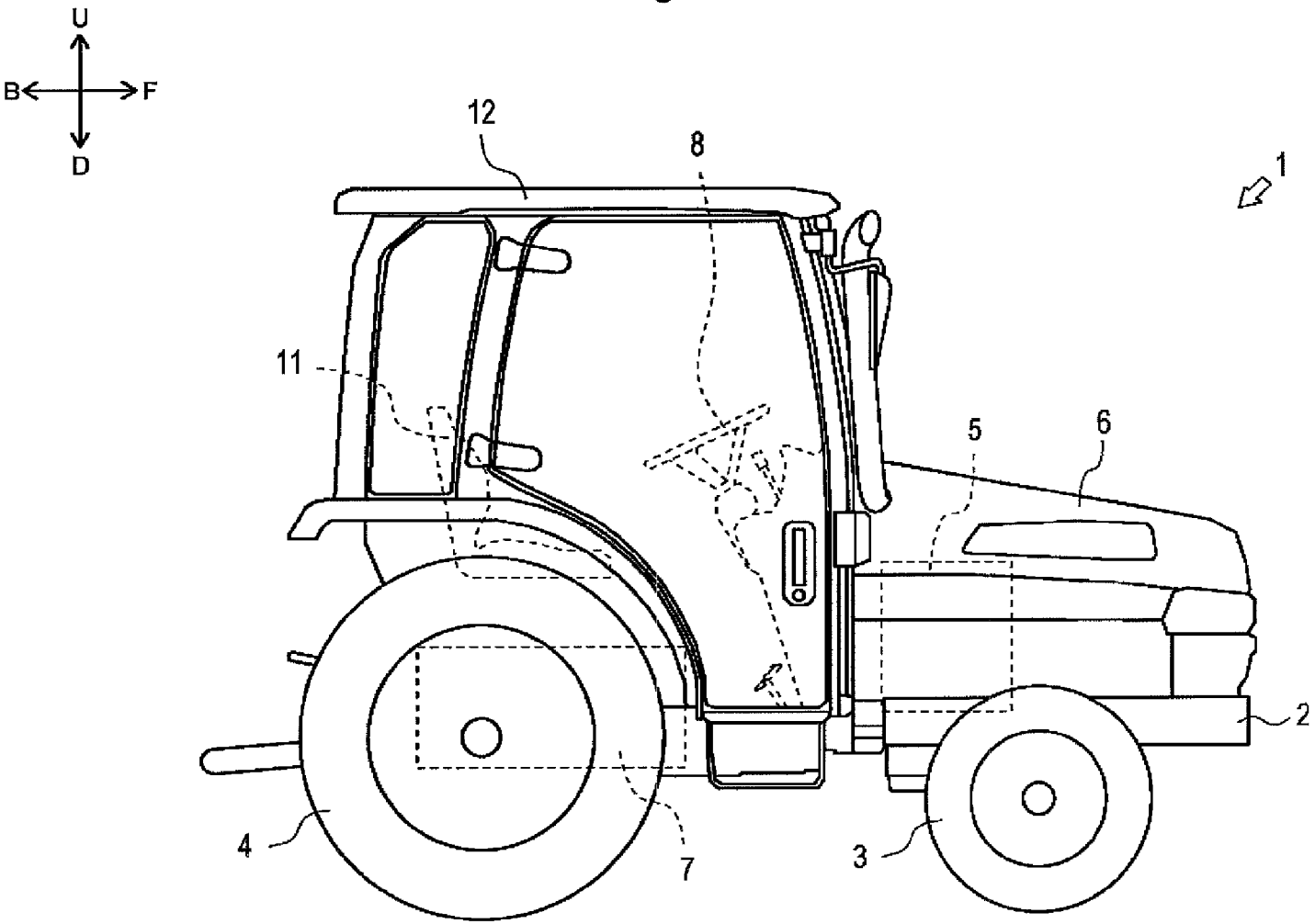
FIG. 1 is a side view showing entirely a tractor relating to one embodiment of the present invention.

Firstly, with reference to FIG. 1, a general construction of a tractor 1 as one embodiment of a working vehicle relating to the present invention will be explained. Meanwhile, in the instant embodiment, the tractor 1 is cited as a working vehicle. Yet, it is understood that the present invention is not limited thereto. Namely, the working vehicle can also be any other agricultural vehicle, a construction working vehicle, an industrial working vehicle, etc.

The tractor 1 includes, as principal constituents thereof, a vehicle body frame 2, front wheels 3, 3, rear wheels 4, 4, an engine 5, a hood 6, a speed changer 7, a steering wheel 8, a seat 11 and a cabin 12. The vehicle body frame 2 is arranged with its longitudinal direction oriented along the front/rear direction. A front portion of the vehicle body frame 2 is supported by the pair of right and left front wheels 3, 3 via a front axle mechanism (not shown). The speed changer 7 is mounted on a rear portion of the vehicle body frame 2. A rear portion of the speed changer 7 is supported by the pair of right and left rear wheels 4, 4 via a rear axle mechanism (not shown). The engine 5 (a diesel engine) is mounted on a front portion of the vehicle body frame 2. And, this engine 5 is housed inside an engine room covered by the hood 6.

Power of the engine 5 is speed-changed by the speed changer 7 and then can be transmitted via the front axle mechanism to the front wheels 3, 3 and can also be transmitted via the rear axle mechanism to the rear wheels 4, 4. With the power of the engine 5, the front wheels 3, 3 and the rear wheels 4, 4 are rotatably driven to propel the tractor 1.

Rearwardly of the engine 5, there is disposed a driving operation section having the steering wheel 8, various operational tools, and the seat 11, etc. This driving operation section is covered by the cabin 12. The steering wheel 8 is disposed at a front portion inside the cabin 12. In accordance with its rotational operation amount, the steering wheel 8 is capable of adjusting (varying) a steering angle of the pair of right and left front wheels 3, 3, thus allowing maneuvering of the tractor 1.

Next, with reference to FIG. 2, layouts of various components provided inside the engine room covered by the hood 6 will be explained in general.

At a rear region of the engine room, the engine 5 is disposed. Forwardly of the engine 5, a radiator 13 is disposed. And, forwardly of this radiator 13, a battery 14 is disposed. An air cleaner 15 is disposed upwardly of the battery 14. Further, inside the engine room, an exhaust gas cleaning device 16 is disposed upwardly of the engine 5.

Figure 9:
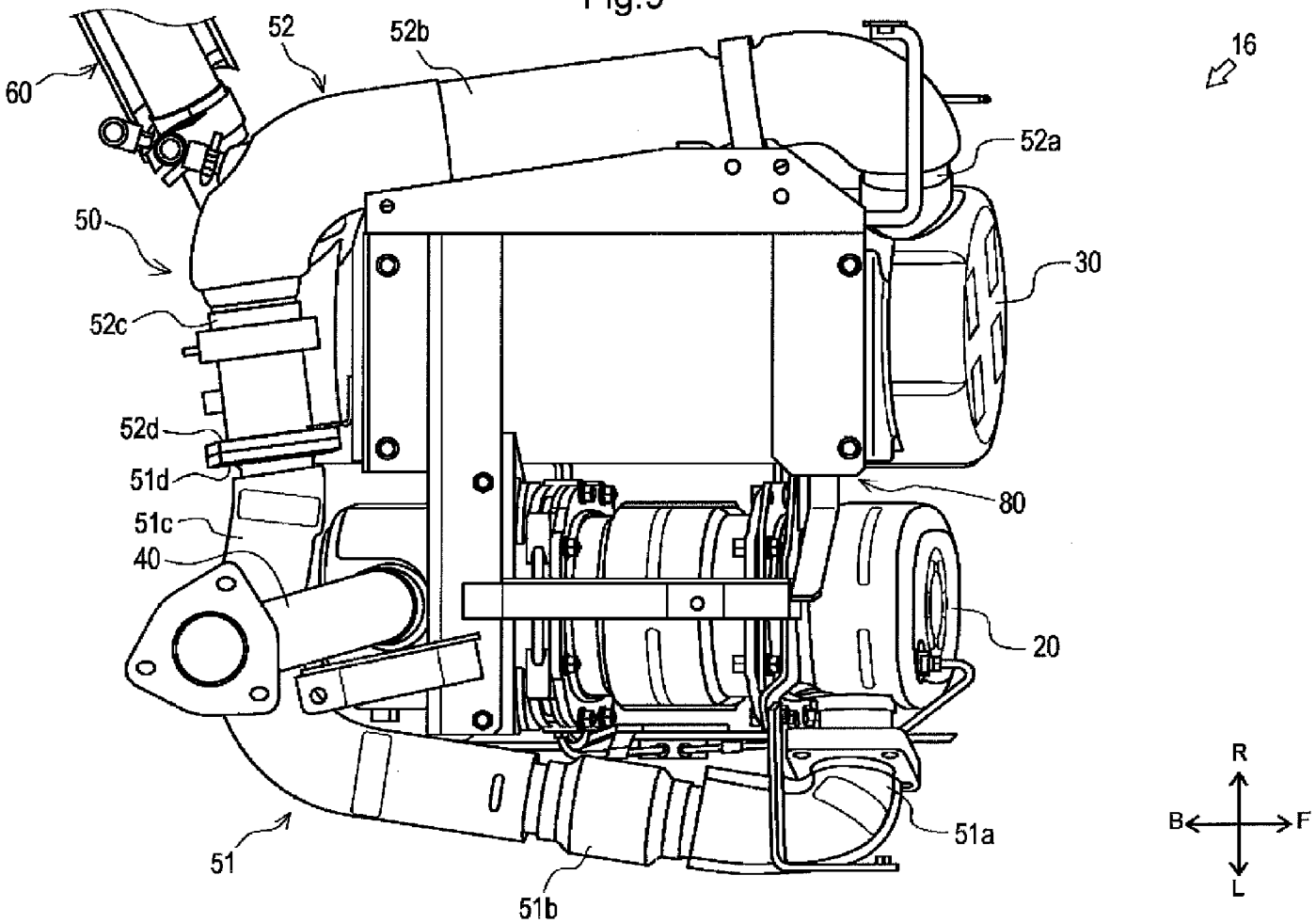
FIG. 9 is a bottom view showing the exhaust gas cleaning device.

Next, with reference to FIGS. 3 through FIG. 9, the exhaust gas cleaning device 16 will be explained. Incidentally, in FIG. 9, illustration of an engine-side bracket 70 which will be described hereinafter is omitted.

This exhaust gas cleaning device 16 is used for cleaning exhaust gas from the engine 5 and discharging the cleaned exhaust gas. The exhaust gas cleaning device 16 includes, as principal constituents thereof, a DPF 20, an SCR 30, an inlet pipe 40, a connecting pipe 50, a muffler 60, the engine-side bracket 70 and an ash-side bracket 80.

Figure 10B:
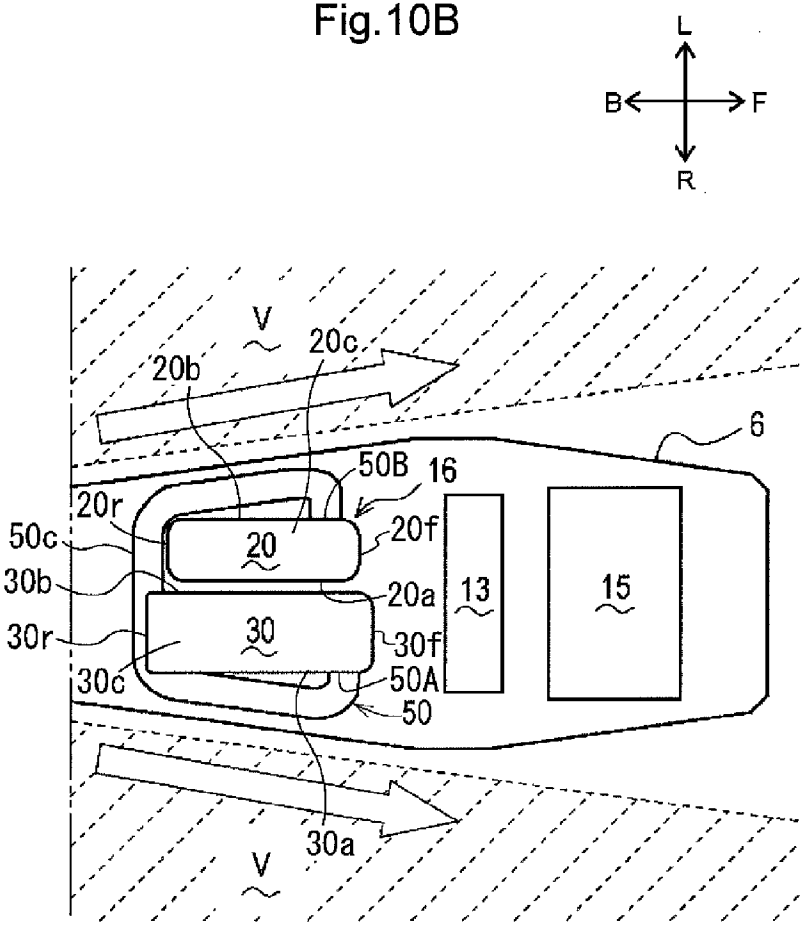
FIG. 10B is a plan view schematically showing the relationship between the exhaust gas cleaning device housed inside the engine room and the viewing field for an operator.
Figure 10A:
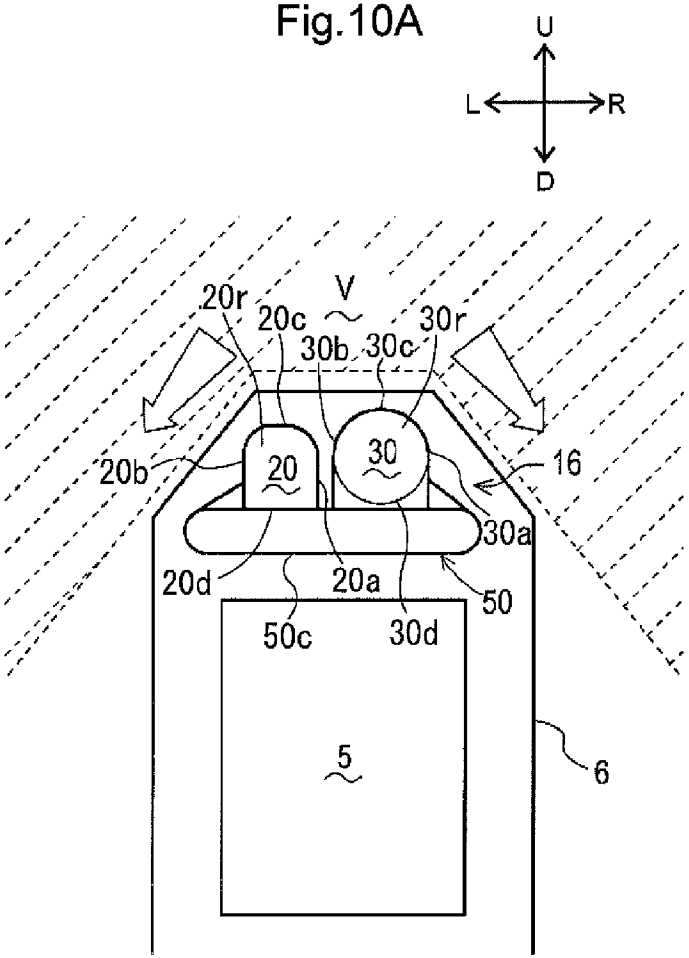
FIG. 10A is a rear view schematically showing relationship between the exhaust gas cleaning device housed inside an engine room and the viewing field for an operator.
Figure 11:
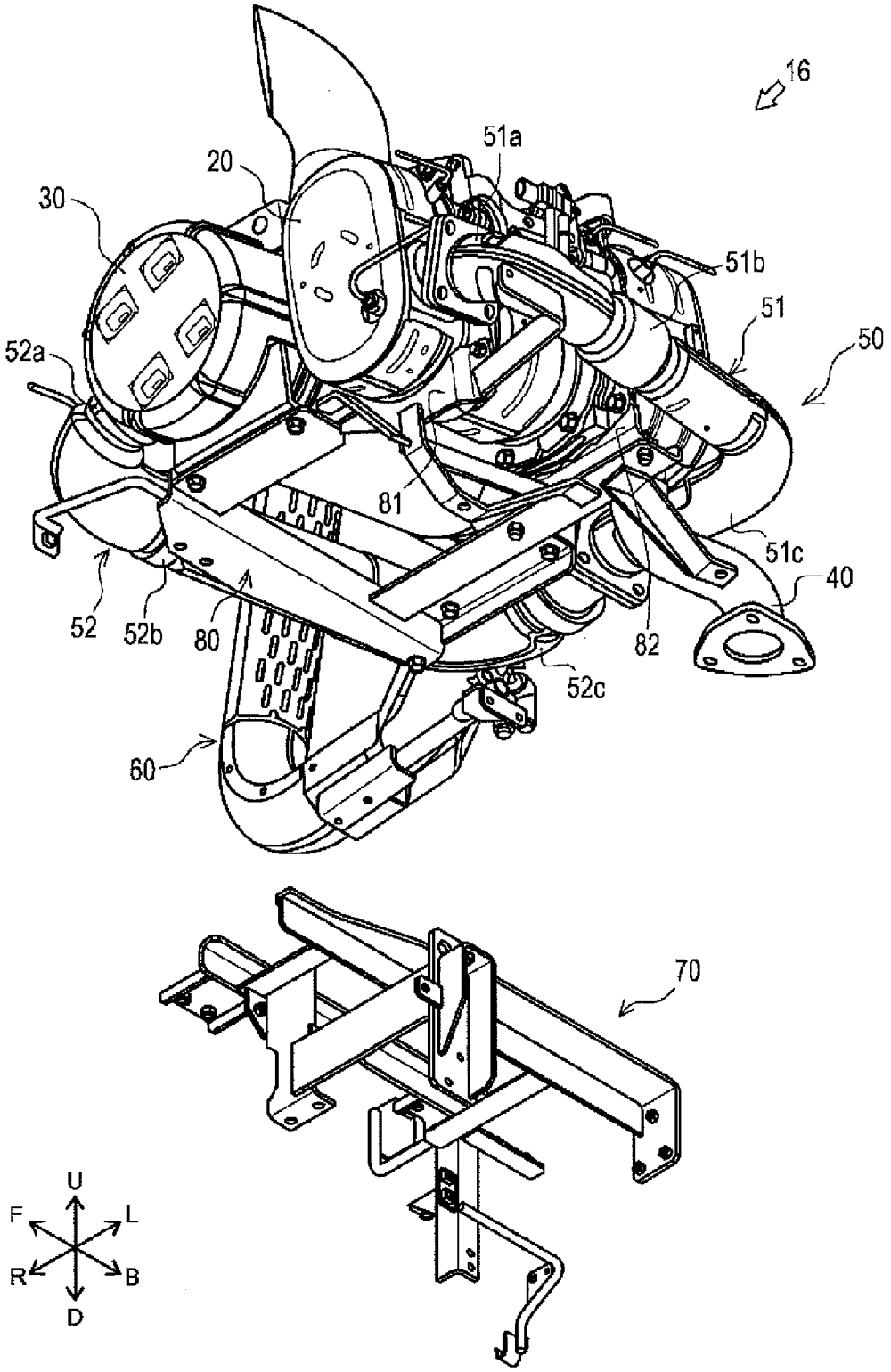
FIG. 11 is a lower exploded perspective view showing the exhaust gas cleaning device.

Now, with reference to FIGS. 10A and 10B, terms used herein for specifying the three-dimensional shapes of the DPF 20 and SCR 30 for the sake of convenience for better understanding will be explained. The DPF 20 includes a first lateral face portion 20*a* representing the right side face area in the forward traveling direction, a second lateral face portion 20*b* representing the left side face area, an upper face portion 20*c*, a bottom face portion 20*d*, a front face portion 20*f* representing an end face area on the front side in the forward traveling direction (front side in the front/rear direction of the vehicle body), and a rear face portion 20*r* representing an end face area on the rear side in the forward traveling direction (rear side in the front/rear direction of the vehicle body). Similarly, the SCR 30 includes a first lateral face portion 30*a* representing the right side face area in the forward traveling direction, a second lateral face portion 30*b* representing the left side face area, an upper face portion 30*c*, a bottom face portion 30*d*, a front face portion 30*f* representing an end face area on the front side in the forward traveling direction (front side in the front/rear direction of the vehicle body), and a rear face portion 30*r* representing an end face area on the rear side in the forward traveling direction (rear side in the front/rear direction of the vehicle body).

The DPF 20 is provided for collecting PM (particulate matters) contained in exhaust gas discharged from the engine 5. The DPF 20 is comprised of a filter or the like for collecting PM mounted in a cylindrical case (a housing). The DPF 20 is disposed at a position upwardly of the engine 5 with an offset to the left side. Also, the DPF 20 is disposed with its longitudinal direction oriented along the front/rear direction. Moreover, the DPF 20 is disposed with a downward inclination from the rear face portion 20*r* toward the front face portion 20*f*. In the instant embodiment, this inclination has an angle ranging from 5 to 20 degrees.

The SCR 30 is provided for cleaning nitrogen oxides contained in the exhaust gas discharged from the engine 5. The SCR 30 is comprised of a catalyst, etc. mounted in a cylindrical case (a housing). The SCR 30 is disposed at a position upwardly of the engine 5 with an offset to the right side (on the immediate right side of the DPF 20). Also, the SCR 30 is disposed with its longitudinal direction oriented along the front/rear direction. Moreover, the SCR 30 is disposed with a downward inclination from the rear face portion 30*r* toward the front face portion 30*f*. In the instant embodiment, this inclination has an angle ranging from 5 to 20 degrees, approximately equal to the inclination angle of the DPF 20. The SCR 30 is formed slightly longer than the DPF 20 in the front/rear direction. Further, the rear face portion 30*r* of the SCR 30 projects more rearwards than the rear face portion 20*r* of the DPF 20.

Figure 12:
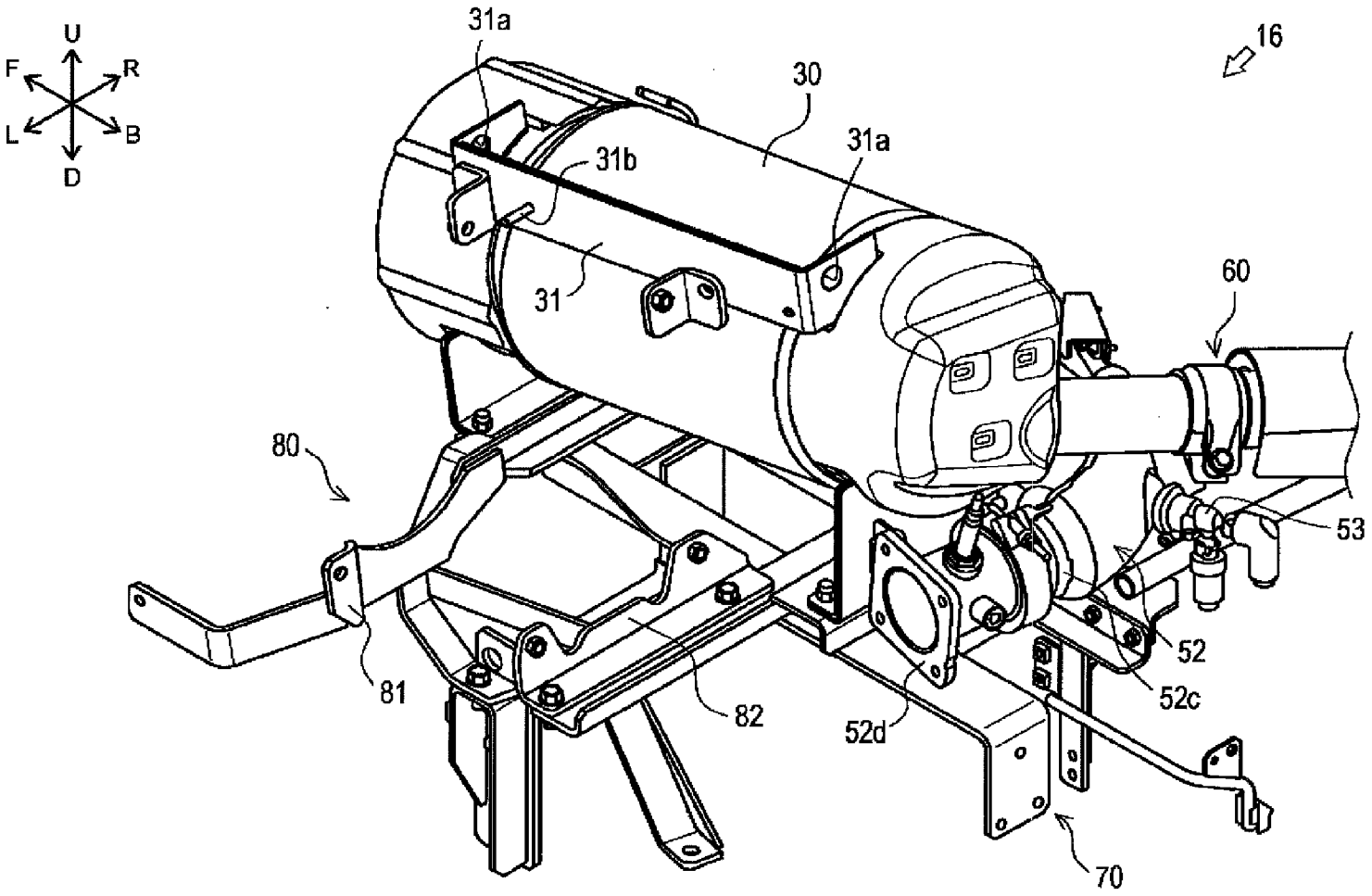
FIG. 12 is a rear perspective view showing the exhaust gas cleaning device with its DPF being detached therefrom.

On top of the second lateral face portion 30*b* of the SCR 30, there is provided an upper connecting bracket 31 for interconnecting the SCR 30 and the DPF 20. This upper connecting bracket 31 is formed of a plate-like member. One end of the upper connecting bracket 31 is welded to the SCR 30 and the other end of the upper connecting bracket 31 can be detachably fixed to the DPF 20 with a bolt or the like. At the front and rear end portions of the upper connecting bracket 31, there are formed through holes 31*a* for allowing engagement of hooks of a crane therein. Further, at a front/rear intermediate portion of the upper connecting bracket 31, there is formed a shaft-like damper attaching portion 31*b* (see FIG. 12) on which a hood damper for damping shock occurring during opening/closing of the hood 6 can be attached. With this, even when the exhaust gas cleaning device 16 is provided upwardly of the engine 5, the hood damper can be attached easily.

The inlet pipe 40 is used for guiding exhaust gas discharged from the engine 5 to the DPF 20. One end (lower end) of the inlet pipe 40 is connected to a left rear portion of engine 5 upper portion. The other end (upper end) of the inlet pipe 40 is connected to an exhaust gas inlet (not shown) formed in the bottom face portion 20*d* near the rear face portion 20*r* of the DPF 20.

The connecting pipe 50 is used for guiding exhaust gas past the DPF 20 to the SCR 30. The connecting pipe 50, if defined in functional terms, includes mainly a DPF-side connecting pipe 51, an SCR-side connecting pipe 52 and a reducing agent supplying nozzle 53. Further, as shown in FIG. 10B, the connecting pipe 50, if defined in structural terms, includes a first connecting end 50A to be connected to the SCR 30, a second connecting end 50B to be connected to the DPF 20, and a main body portion 50C extending from the first connecting end 50A to the second connecting end 50B. The main body portion 50C extends substantially in U-shape and has a U-shape slightly widened at its free ends.

The DPF-side connecting pipe 51 consists of a first extension portion 51*a*, a second extension portion 51*b* and a third extension portion 51*c*.

One end of the first extension portion 51*a* is connected to an exhaust gas outlet (not shown) formed at a lower portion of the front end region of the second lateral face portion 20*b* of the DPF 20. The other end of the first extension portion 51*a* is formed to extend downwardly to the outer side from the one end of this first extension portion 51*a*.

The second extension portion 51*b* is formed to extend substantially horizontally from the end of the first extension portion 51*a* toward the rear side in the vehicle body front/rear direction. More particularly, this second extension portion 51*b* extends rearwards towards the inner side (the vehicle body center side). The rear end of the second extension portion 51*b* extends to the vicinity of the rear face portion 20*r* of the DPF 20 (more particularly, to a position slightly rearwardly of the rear face portion 20*r* of the DPF 20 in the front/rear direction).

The third extension portion 51*c* is formed to extend substantially horizontally from the rear end of the second extension portion 51*b* toward the vehicle body center side. The rear end of the third extension portion 51*c* extends to the approximate center of the engine 5 relative to the vehicle body traverse direction. At the terminal end of the third extension portion 51*c*, a flange 51*d* is formed.

The SCR-side connecting pipe 52 includes a first extension portion 52*a*, a second extension portion 52*b* and a third extension portion 52*c*.

One end of the first extension portion 52*a* is connected to an exhaust gas inlet (not shown) formed at a lower portion of the front end region of the first lateral face portion 30*a* of the SCR 30. The other end of the first extension portion 52*a* is formed to extend downwardly to the outer side from the one end of this first extension portion 52*a*.

The second extension portion 52*b* is formed to extend substantially horizontally from the end of the first extension portion 52*a* toward the rear side in the vehicle body front/rear direction. More particularly, this second extension portion 52*b* extends rearwards towards the inner side (the vehicle body center side). The rear end of the second extension portion 52*b* extends to the vicinity of the rear face portion 30*r* of the SCR 30 (more particularly, to an approximately same position as the rear face portion 30*r* of the SCR 30 in the front/rear direction).

The third extension portion 52*c* is formed to extend substantially horizontally from the rear end of the second extension portion 52*b* toward the vehicle body center side. In this, a portion of the third extension portion 52*c* (more particularly, a front region of the third extension portion 52*c*) passes under the rear face portion 30*r* of the SCR 30. The rear end of the third extension portion 52*c* extends to the approximate center of the engine 5 relative to the vehicle body traverse direction. At the terminal end of the third extension portion 52*c*, a flange 52*d* is formed. When this flange 52*d* is fixedly connected to the flange 51*d* of the DPF-side connecting pipe 51, the DPF-side connecting pipe 51 and the SCR-side connecting pipe 52 are connected to each other. The connecting pipe 50 exhibits a slightly widened U-shape in its plane view.

The reducing agent supplying nozzle 53 is used for injecting an amount of urea water solution into the connecting pipe 50 (the SCR-side connecting pipe 52). The reducing agent supplying nozzle 53 is provided to the SCR-side connecting pipe 52 (vicinity of the connecting portion between the second extension portion 52*b* and the third extension portion 52*c*). The reducing agent supplying nozzle 53 is connected to an unillustrated tank and is capable of injecting the urea water solution stored in this tank into the SCR-side connecting pipe 52.

With the above-described arrangements, the connecting pipe 50, as a whole, is disposed at positions lower than the upper ends of the DPF 20 and the SCR 30. Further, the right-left width of the connecting pipe 50 as a whole (the width from the DPF-side connecting pipe 51 to the SCR-side connecting pipe 52) is configured to progressively decrease from the front to the rear side thereof. Further, as the connecting pipe 50 is formed to pass the rear face portion 20*r* of the DPF 20 and the rear face portion 30*r* of the SCR 30, a longer total length can be secured for this connecting pipe 50. With this, it is possible to effectively promote mixing between the urea water solution injected from the reducing agent supplying nozzle 53 and exhaust gas.

The muffler 60 is used for discharging exhaust gas to the outside with reducing the exhaust noise. One end of the muffler 60 is connected to an exhaust gas outlet (not shown) formed at a lower portion of the rear end region of the first lateral face portion 30*a* of the SCR 30. The muffler 60 is formed to extend firstly by a predetermined distance from its one end connected to the SCR 30 to the right side and then to extend upwards. As the SCR 30 is inclined with its rear portion being higher than its front portion, the muffler 60 passes above the connecting pipe 50 to extend in the direction away from the vehicle body center and then to rise up.

The engine-side bracket 70 and the ash-side bracket 80 are used for mounting (fixing) the DPF 20 and the SCR 30 upwardly of the engine 5 in the manner described above. The constructions of the engine-side bracket 70 and the ash-side bracket 80 will be described later herein.

In operation of the exhaust gas cleaning device 16 configured as above, exhaust gas discharged from the engine 5 is guided via the inlet pipe 40 to the DPF 20. In the course of passage of the exhaust gas through the inside of the DPF 20, PM contained in this exhaust gas is collected.

The exhaust gas past the DPF 20 is then guided to the SCR 30 via the connecting pipe 50. In the course of this, into the gas flowing in the connecting pipe 50, an amount of urea water solution is injected via the reducing agent supplying nozzle 53. This urea water solution is hydrolyzed inside the connecting pipe 50, whereby ammonia as a reducing agent is produced. The exhaust gas and the produced ammonia are mixed well inside the connecting pipe 50 (SCR-side connecting pipe 52). Then, in the SCR 30, this ammonia is chemically reacted with nitrogen oxides contained in the exhaust gas, so that these nitrogen oxides are reduced to nitrogen as a harmless substance and water. The exhaust gas past the SCR 30 is discharged to the outside via the muffler 60.

Next, with reference to FIG. 2 and FIG. 10, there will be explained a viewing field for an operator when the exhaust gas cleaning device 16 is disposed inside the hood 6.

Figure 2:
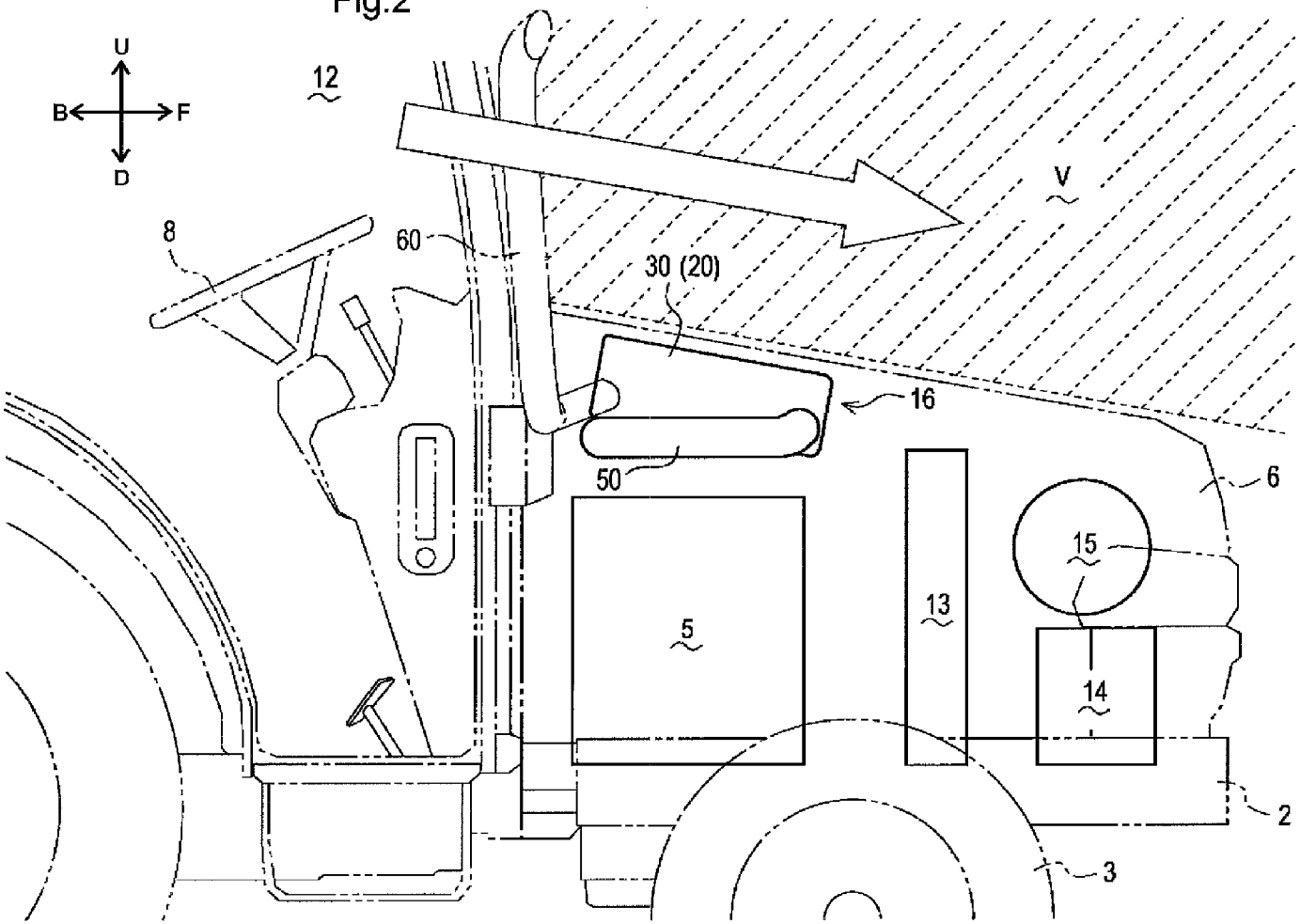
FIG. 2 is a schematic side view showing an exhaust gas cleaning device housed inside a hood and a viewing field for an operator.
Figure 3:
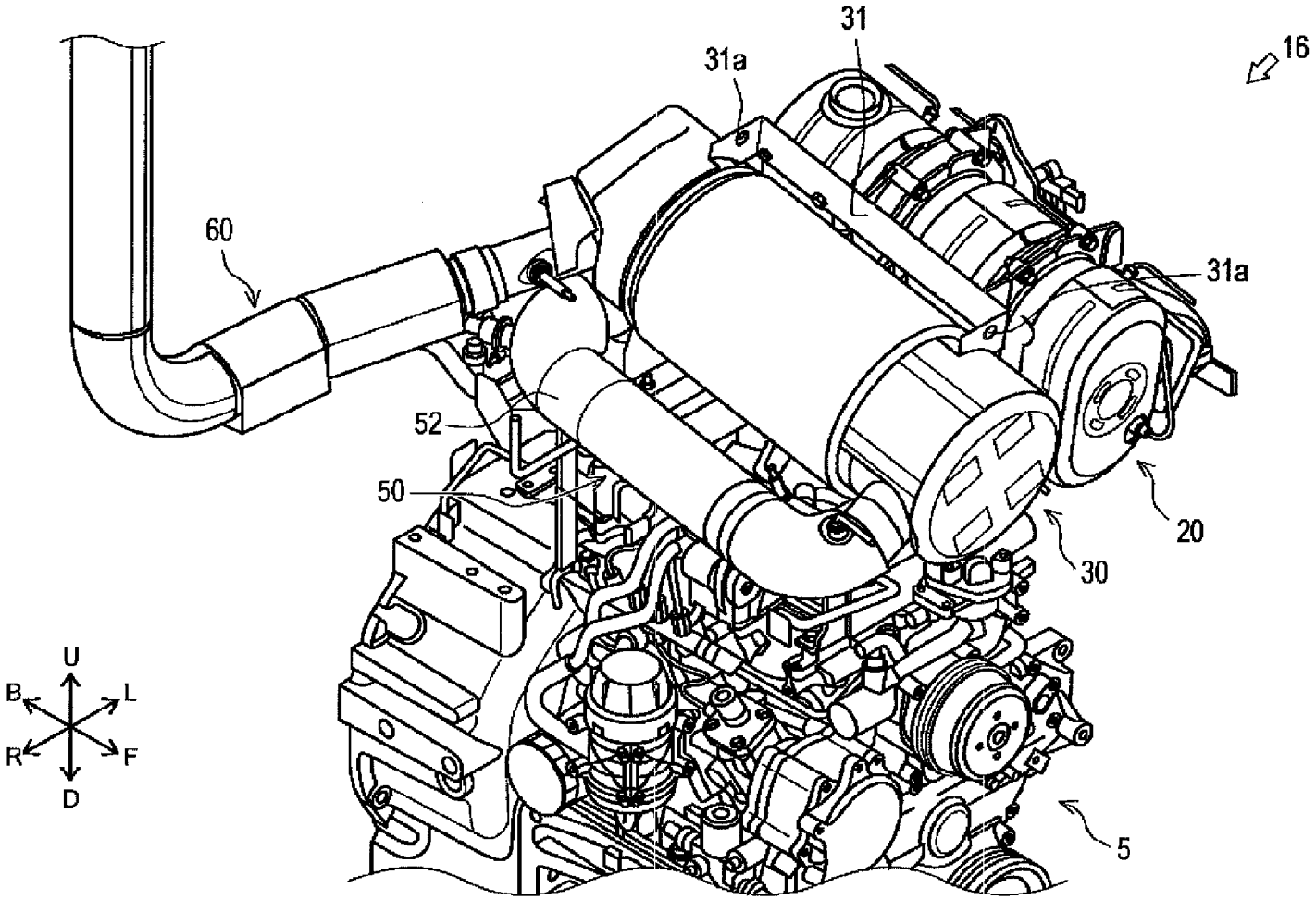
FIG. 3 is a front perspective view showing the exhaust gas cleaning device.
Figure 4:
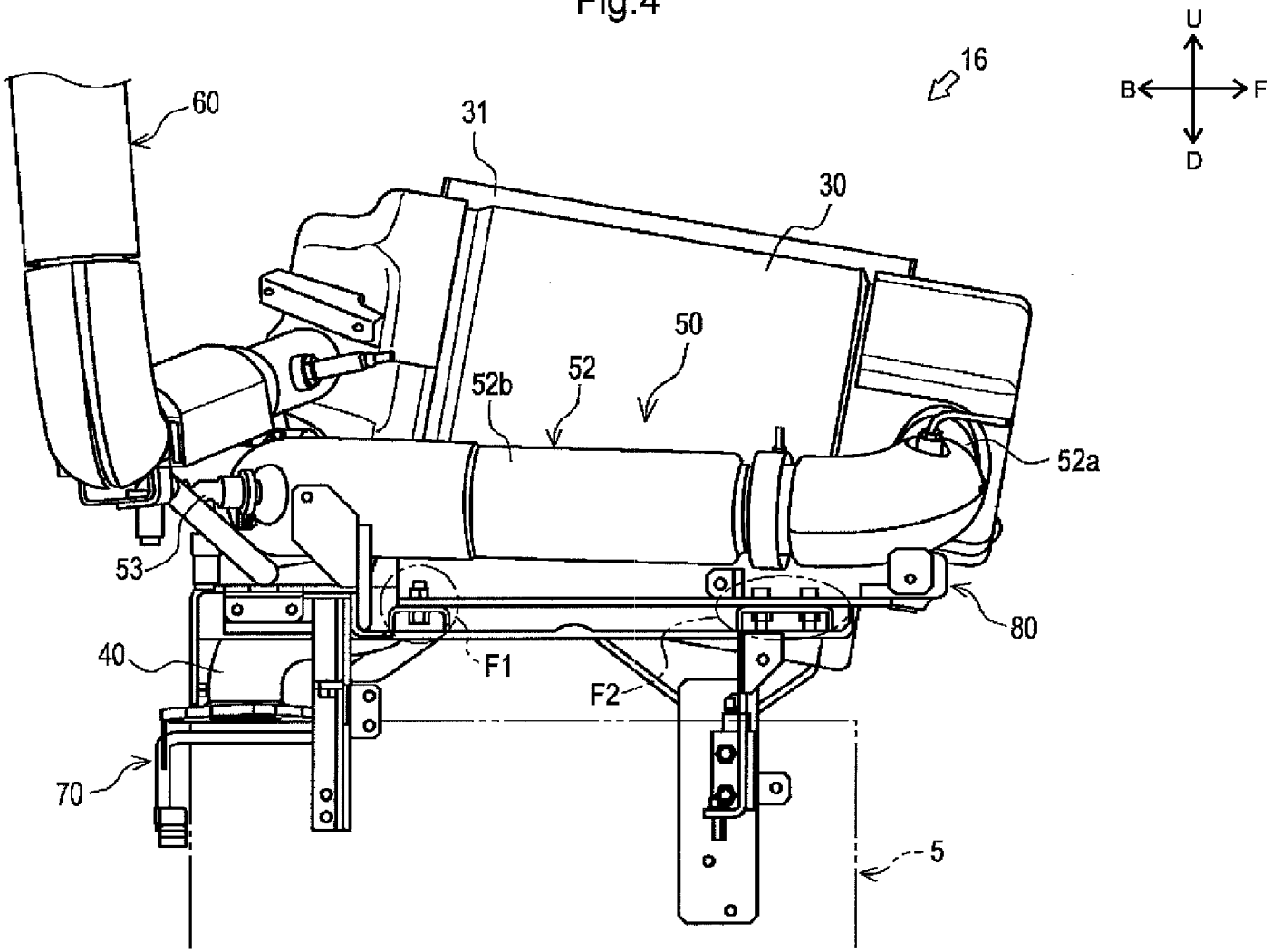
FIG. 4 is a right side view showing the exhaust gas cleaning device.
Figure 5:
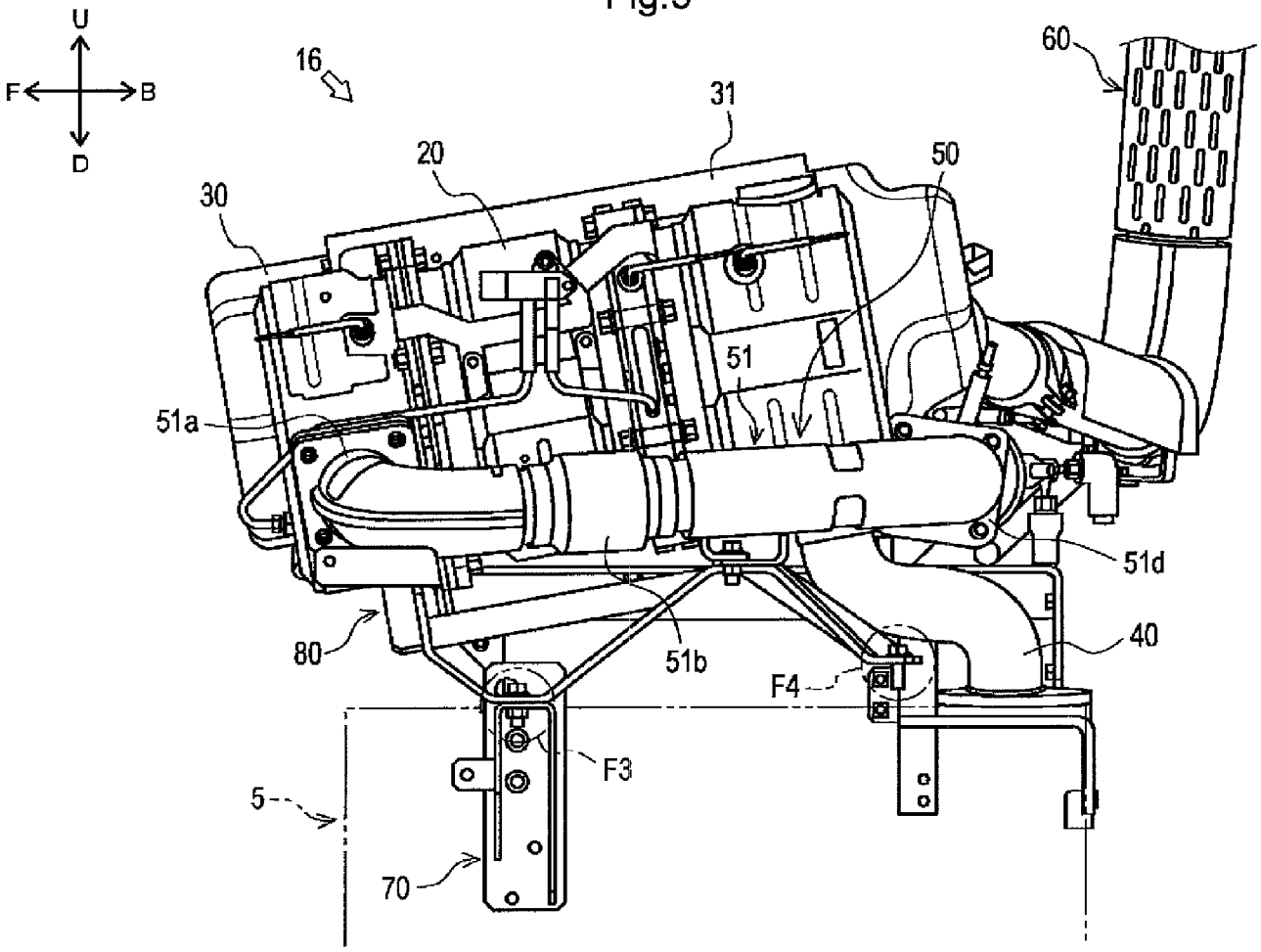
FIG. 5 is a left side view showing the exhaust gas cleaning device.
Figure 6:
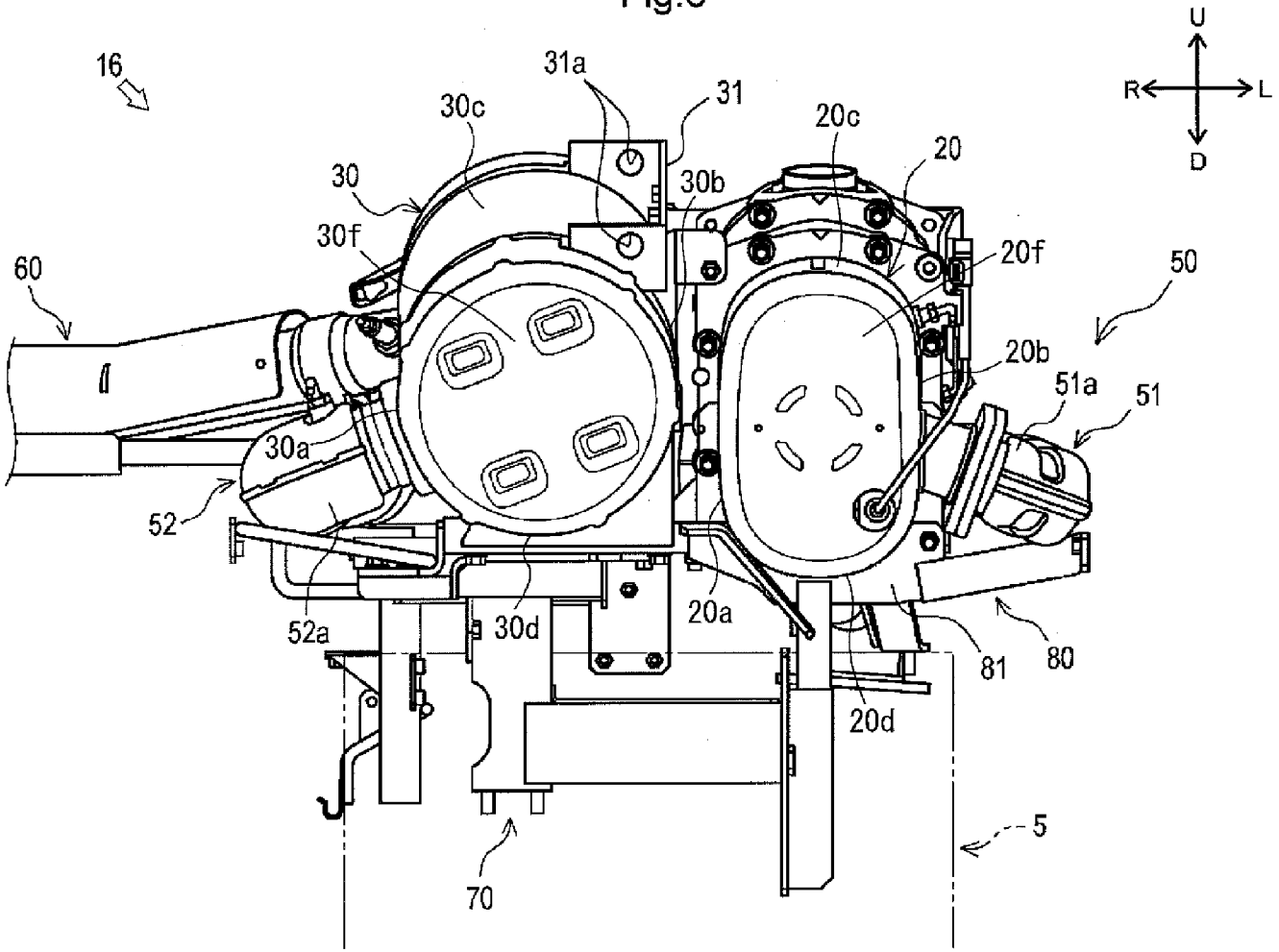
FIG. 6 is a front view showing the exhaust gas cleaning device.
Figure 7:
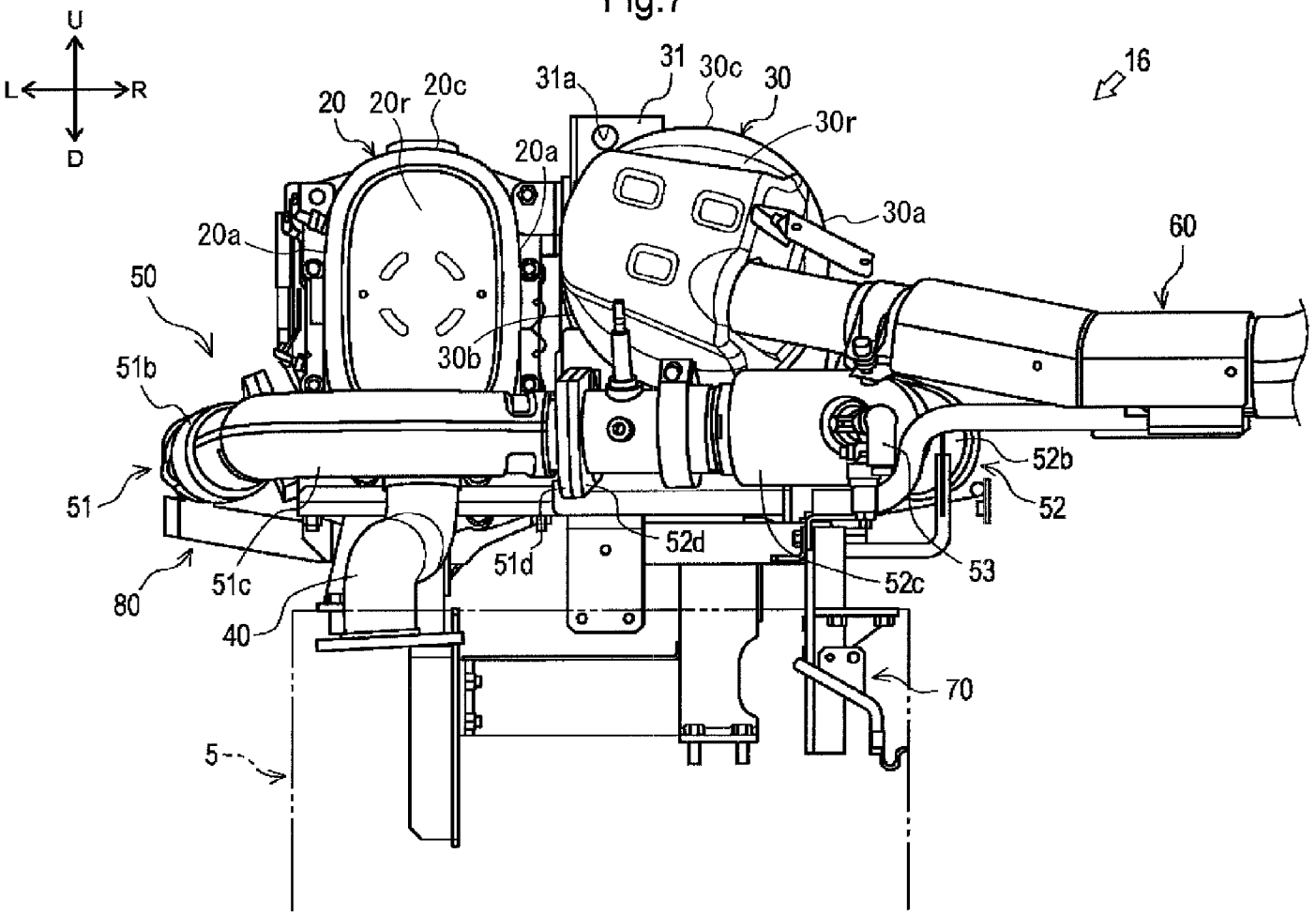
FIG. 7 is a rear view showing the exhaust gas cleaning device.
Figure 8:
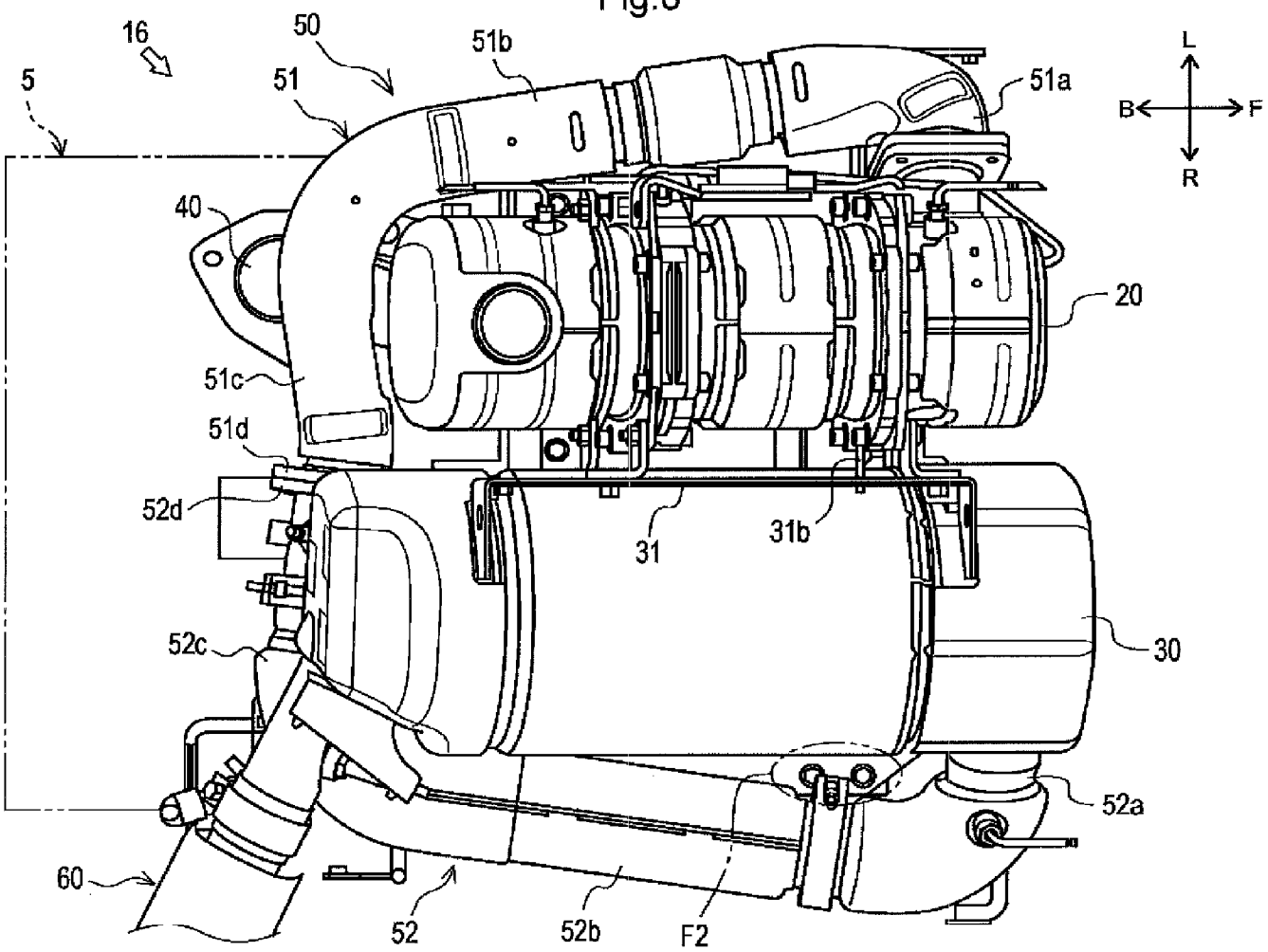
FIG. 8 is a plan view showing the exhaust gas cleaning device.

As described above, as the DPF 20 and the SCR 30 are disposed with the downward inclinations, as illustrated in FIG. 2, the upper face of the hood 6 can be formed with an inclination downward forwardly. With this, in comparison with a case of forming the upper face of the hood 6 substantially horizontal, it is possible to secure a wider viewing field V for the operator (in particular, in the forward downward direction (see the arrow in the drawing)).

Further, as described above, as the connecting pipe 50 is disposed at positions lower than the upper ends of the DPF 20 and the SCR 30, as illustrated in FIG. 10 (A), it is possible to form the heights of the opposed ends of the upper face of the hood 6 in the vehicle body traverse direction (the peripheries of the DPF 20 and the SCR 3) lower (downwardly inclined toward the lateral face). With this, in comparison with a case of forming the upper face of the hood 6 with a constant height, it is possible to secure a wider viewing field V for the operator (in particular, in the obliquely right/left forwardly downward direction).

Further, as described above, as the right-left width of the connecting pipe 50 as a whole (the length in the vehicle body traverse direction) is formed to progressively decrease from the front portion to the rear portion, as illustrated in FIG. 10 B, it is possible to form such that the width of the hood 6 in the vehicle body traverse direction progressively increases from the rear end portion to the front side. With this, in comparison with a case of forming the right-left width of the hood constant, it is possible to secure a wider viewing field V for the operator (in particular, in the obliquely forward in the vehicle body traverse direction).

Next, with reference to FIG. 4, FIG. 5, FIG. 8, FIG. 11 and FIG. 12, the constructions of the engine-side bracket 70 and the ash-side bracket 80 will be explained.

The engine-side bracket 70 is used for fixing the DPF 20 and the SCR 30 upwardly of the engine 5. The engine-side bracket 70 is comprised of multiple plate members or the like. The engine-side bracket 70 has a shape capable of fixing its lower portion to an upper portion of the engine 5. Further, the engine-side bracket 70 has a shape capable of fixing its upper portion to a lower portion of the ash-side bracket 80 to be described later herein. The engine-side bracket 70 will be fixed to an upper portion of the engine 5 in advance, when it is used for fixing the DPF 20 and the SCR 30 upwardly of the engine 5.

The ash-side bracket 80 also is used for fixing the DPF 20 and the SCR 30 upwardly of the engine 5. The ash-side bracket 80 is comprised of multiple plate members, or the like. The ash-side bracket 80 has a shape capable of fixing its upper portion to the DPF 20 and the SCR 30. In particular, the DPF 20 needs to be dismounted and mounted again at the time of maintenance, after it is once fixed to the engine 5. For this reason, the ash-side bracket 80 includes a pair of attaching faces (an attaching face 81 and an attaching face 82) formed erect to orient the faces thereof along the vehicle body front/rear direction, and the DPF 20 is fixed to these faces with bolts or the like. With bolt operations of these attaching faces 81, 82 from the front or lateral side, dismounting and mounting of the DPF 20 can be carried out easily.

The DPF 20 and the SCR 30 will be fixed to an upper portion of the ash-side bracket 80 in advance, before this ash-side bracket 80 is fixed to an upper portion of the engine-side bracket 70. In the course of this, with the upper connecting bracket 31 of the SCR 30, this SCR 30 and the upper portion of the DPF 20 are connected to each other. In this way, the DPF 20, the SCR 30 and the ash-side bracket 80 will be fixed to each other in advance before they are fixed to the upper portion of the engine 6 (the engine-side bracket 70).

Further, the ash-side bracket 80 has a shape capable of fixing its lower portion to the engine-side bracket 70 and the upper portion of the engine 5. More particularly, the ash-side bracket 80 is fixed to the engine-side bracket 70 and the upper portion of the engine 5 at an attaching portion F1, an attaching portion F2, an attaching portion F3 and an attaching portion F4 (see FIG. 4 and FIG. 5), with bolts or the like. In this, the attaching portion F2 is located on the inner side of the connecting pipe 50 (the SCR-side connecting pipe 52), fastening of the bolts or the like from the lateral side is difficult. However, fastening of the bolts or the like from the upper side (through a gap (see FIG. 8) formed between the SCR-side connecting pipe 52 and the SCR 30) is possible with use of a tool.

As described above, when the DPF 20 and the SCR 30 are to be fixed to the engine 5, the DPF 20, the SCR 30 and the ash-side bracket 80 connected together will be fixed to the upper portion of the engine 5. In this, the fixing operation is possible with lifting up the DPF 20, etc. connected together, by hooks of a cane engaged in the through holes 31*a* formed in the upper connecting bracket 31 of the SCR 30.

[Other Embodiments]

(1) Different from the foregoing embodiment, the DPF 20 and the SCR 30 can be disposed in reverse on the right and left in the vehicle body traverse direction.

(2) In the foregoing embodiment, a portion (the front portion in the vehicle body front/rear direction) of the connecting pipe 50 (the third extension portion 52*c*) is caused to pass under the SCR 30. Instead, it is also possible to arrange such that not only the front portion, but also the rear portion, that is, substantial entirety of the main body portion 50C is caused to pass under the SCR 30.

(3) In the foregoing embodiment, the connecting pipe 50 is caused to pass under a rear end region of the SCR 30. Instead, it is also possible to cause the pipe 50 to pass under a rear end region of the DPF 20 or to pass under the rear end regions of both the DPF 20 and the SCR 30.

(4) The constructions of the DPF 20 and the SCR 30 are not limited to those in the foregoing embodiment. Instead, e.g. a DOC (a Diesel Oxidation Catalyst) may be provided additionally on the upstream side of the filter of the DPF 20.

(5). The reducing agent for use in the SCR 30 is not limited to ammonia.

The invention claimed is:

1. A working vehicle having an exhaust gas cleaning device, comprising:

a driving operation section;

an engine disposed in an engine room covered by a hood disposed forwardly of the driving operation section;

a DPF mounted upwardly of the engine, the DPF including an upper face portion, a bottom face portion, a first lateral face portion facing a laterally inner side of a vehicle body, and a second lateral face portion facing a first laterally outer side of the vehicle body;

an SCR disposed upwardly of the engine in juxtaposition with the DPF in a vehicle body transverse direction, the SCR including an upper face portion, a bottom face portion, a first lateral face portion facing a second laterally outer side of the vehicle body opposite to the first laterally outer side, and a second lateral face portion facing the laterally inner side of the vehicle body; and a connecting pipe including a first connecting end connected to the first lateral face portion of the SCR, a second connecting end connected to the second lateral face portion of the DPF, and a main body portion extending from the first connecting end to the second connecting end, the main body portion extending along the second lateral face portion of the DPF and the first lateral face portion of the SCR at positions lower than the upper face portion of the DPF and the upper face portion of the SCR.

2. The work vehicle according to claim 1, wherein:

the DPF and the SCR respectively include a front face portion as a front end in a vehicle body front/rear direction and a rear face portion as a rear end in the vehicle body front/rear direction.

3. The work vehicle according to claim 2, wherein:

the first connecting end of the connecting pipe is connected to the first lateral face portion of the SCR at a location closer to the front face portion of the SCR than the rear face portion of the SCR and the second connecting end of the connecting pipe is connected to the second lateral face portion of the DPF at a location closer to the front face portion of the DPF than the rear face portion of the DPF; and as viewed from above, the main body portion of the connecting pipe extends in a U-shape form rearwards in the vehicle body front/rear direction, with a width thereof in the vehicle body traverse direction progressively increased to the forward side.

4. The work vehicle according to claim 2, wherein:

the DPF is disposed with an inclination such that the front face portion is disposed higher than the rear face portion; and at least a portion of the main body portion of the connecting pipe passes under the rear face portion of the DPF disposed with the inclination.

5. The work vehicle according to claim 4, wherein:

the first connecting end of the connecting pipe is connected to the first lateral face portion of the SCR at a location closer to the front face portion of the SCR than the rear face portion of the SCR; and the second connecting end of the connecting pipe is connected to the second lateral face portion of the DPF at a location closer to the front face portion of the DPF than the rear face portion of the DPF; and as viewed from above, the main body portion of the connecting pipe extends in a U-shape form rearwards in the vehicle body front/rear direction, with a width thereof in the vehicle body traverse direction progressively increased to the forward side.

6. The work vehicle according to claim 2, wherein the SCR is disposed with an inclination such that the front face portion is disposed higher than the rear face portion; and at least a portion of the main body portion of the connecting pipe passes under the rear face portion of the SCR disposed with the inclination.

7. The work vehicle according to claim 6, wherein:

the first connecting end of the connecting pipe is connected to the first lateral face portion of the SCR at a location closer to the front face portion of the SCR than the rear face portion of the SCR; and the second connecting end of the connecting pipe is connected to the second lateral face portion of the DPF at a location closer to the front face portion of the DPF than the rear face portion of the DPF; and as viewed from above, the main body portion of the connecting pipe extends in a U-shape form rearwards in the vehicle body front/rear direction, with a width thereof in the vehicle body traverse direction progressively increased to the forward side.

8. The work vehicle according to claim 1, wherein a muffler for discharging exhaust gas to the outside is connected to the rear face portion or its periphery of the SCR, and the main body portion of the connecting pipe passes under the muffler.

9. The work vehicle according to claim 1, wherein an inlet pipe connected to the engine is connected to a rear region of the bottom face portion of the DPF.

10. The work vehicle according to claim 9, wherein the inlet pipe is bent to pass under the main body portion of the connecting pipe.

11. The work vehicle according to claim 1, wherein the main body portion of the connecting pipe extends on a horizontal plane.

12. The work vehicle according to claim 11, wherein an inclined plane delimited by the bottom face portions of the DPF and the SCR has an inclination angle from 5 to 20 degrees relative to the horizontal plane delimited by the main body portion of the connecting pipe.

13. The work vehicle according to claim 1, wherein:

as viewed from above, the main body portion of the connecting pipe extends in a U-shape form rearwards in the vehicle body front/rear direction.

* * * * *